US007900912B2

(12) United States Patent
Moriyama et al.

(10) Patent No.: US 7,900,912 B2
(45) Date of Patent: Mar. 8, 2011

(54) SHEET PROCESSING APPARATUS AND IMAGE FORMING SYSTEM

(75) Inventors: Tsuyoshi Moriyama, Toride (JP); Hitoshi Kato, Toride (JP); Shunsuke Nishimura, Toride (JP); Naoto Watanabe, Kashiwa (JP)

(73) Assignee: Canon Kabushiki Kaisha (JP)

( * ) Notice: Subject to any disclaimer, the term of this patent is extended or adjusted under 35 U.S.C. 154(b) by 71 days.

(21) Appl. No.: 11/463,667

(22) Filed: Aug. 10, 2006

(65) Prior Publication Data

US 2007/0045925 A1 Mar. 1, 2007

(30) Foreign Application Priority Data

Aug. 29, 2005 (JP) ..... 2005-248159

(51) Int. Cl.
*B65H 31/26* (2006.01)
*B65H 31/00* (2006.01)

(52) U.S. Cl. ..... 271/220; 271/207

(58) Field of Classification Search ..... 270/58.09; 271/207, 220

See application file for complete search history.

(56) References Cited

U.S. PATENT DOCUMENTS 5,462,265 A * 10/1995 Mandel et al. ..... 270/58.09
5,772,197 A * 6/1998 Aoki et al. ..... 270/58.08
5,895,036 A * 4/1999 Asao ..... 270/58.09
5,992,838 A * 11/1999 Saitoh ..... 270/58.09
6,098,975 A * 8/2000 Kobayashi ..... 270/58.09
6,219,503 B1 4/2001 Miyake et al.
6,244,583 B1 * 6/2001 Ohmichi et al. ..... 270/58.09
6,871,042 B2 * 3/2005 Nemura et al. ..... 399/389
6,988,730 B2 * 1/2006 Fukatsu et al. ..... 271/306
6,991,225 B2 * 1/2006 Miyake et al. ..... 270/58.09
7,354,036 B2 * 4/2008 Hayashi et al. ..... 270/58.12
2002/0014733 A1 2/2002 Miyake et al.
2003/0184010 A1 * 10/2003 Kato et al. ..... 271/207
2004/0178572 A1 * 9/2004 Nishimura et al. ..... 271/298
2004/0183249 A1 * 9/2004 Sato ..... 271/220
2006/0038337 A1 * 2/2006 Kobayashi ..... 270/58.09
2006/0231999 A1 * 10/2006 Moteki ..... 270/58.09
2007/0194521 A1 * 8/2007 Matsumoto et al. ..... 271/270

FOREIGN PATENT DOCUMENTS

JP 11-130328 A 5/1999

* cited by examiner

*Primary Examiner* — Stefanos Karmis
*Assistant Examiner* — Patrick Cicchino
(74) *Attorney, Agent, or Firm* — Rossi, Kimms & McDowell LLP

(57) ABSTRACT

Provided is a sheet processing apparatus connected to an image forming apparatus, including: an intermediate process tray which receives sheets delivered from the image forming apparatus as a sheet stack; a process unit which applies a predetermined process for the sheet stack received on the intermediate process tray; a pair of rollers which nips and delivers the sheet stack subjected to the predetermined process by the process unit; a stack tray which receives the sheet stack delivered by the pair of rollers; and a controller moves one roller of the pair of rollers to a standby position corresponding to a thickness of the sheet stack to be delivered onto the stack tray.

7 Claims, 9 Drawing Sheets

SHEET PROCESSING APPARATUS AND IMAGE FORMING SYSTEM

BACKGROUND OF THE INVENTION

1. Field of the Invention

The present invention relates to a sheet processing apparatus for performing a sheet processing such as a sort process and a staple process, and to an image forming system.

2. Description of the Related Art

Up to now, known is a sheet processing apparatus for performing a post-treatment such as a sort process and a staple process for a sheet delivered from an image forming apparatus or the like. In the sheet processing apparatus of this kind, the sheet delivered from the image forming apparatus or the like is received on an intermediate process tray to be subjected to the post-treatment such as the sort process and the staple process for a sheet stack on the intermediate process tray. The sheet stack subjected to the post-treatment is nipped by a pair of delivery rollers and is transported to a stack tray to be stacked (see U.S. Pat. No. 6,219,503).

In this case, the pair of delivery rollers is controlled to be in an open (i.e., spaced) state during the post-treatment for the sheet stack on the intermediate process tray, and to be in a closed state after the post-treatment is completed.

However, in conventional sheet processing apparatuses, a control of an opening amount of the pair of delivery rollers is not performed during the post-treatment for the sheet stack on the intermediate process tray, so the opening amount of the pair of delivery rollers is kept constant irrespective of a thickness of the sheet stack. As a result, even when the sheet stack is thin, there is required a certain period of time for an opening/closing operation of the pair of delivery rollers.

On the other hand, with an increase in processing speed of an image forming apparatus in recent years, the high processing speed is also demanded in the sheet processing apparatus. Thus, a waste of time such as a certain period of time required for the opening/closing operation of the pair of delivery rollers cannot be ignored any more, so it is demanded that the opening/closing operation of the pair of delivery rollers is performed swiftly to speed up the delivery process of the sheet stack.

To satisfy the demand, there is a possible way in which the opening/closing operation of the pair of delivery rollers itself is speeded up. However, even when the opening and closing operation of the pair of delivery rollers is simply speeded up, there arises a problem in that the pair of delivery rollers is bounced when the pair of delivery rollers is closed to nip the sheet stack, thereby causing vibration and noise.

SUMMARY OF THE INVENTION

The present invention has been made in the above-mentioned background, and therefore has an object to provide a sheet processing apparatus, a control method, and a program in which a delivery process for a sheet stack delivered from an intermediate process tray may be speeded up without causing any new problems.

To attain the above-mentioned object, according to an aspect of the present invention, a sheet processing apparatus connected to an image forming apparatus, includes: an intermediate process tray which receives sheets delivered from the image forming apparatus as a sheet stack; a process unit which applies a predetermined process for the sheet stack received on the intermediate process tray; a pair of rollers which nips and delivers the sheet stack subjected to the predetermined process by the process unit; a stack tray which receives the sheet stack delivered by the pair of rollers; and a controller which moves one roller of the pair of rollers to a standby position corresponding to a thickness of the sheet stack to be delivered onto the stack tray.

Other objects and features of the present invention will become apparent as follows in this specification with reference to the accompanying drawings.

Further features of the present invention will become apparent from the following description of exemplary embodiments (with reference to the attached drawings).

DESCRIPTION OF THE EMBODIMENTS

Figure 1:
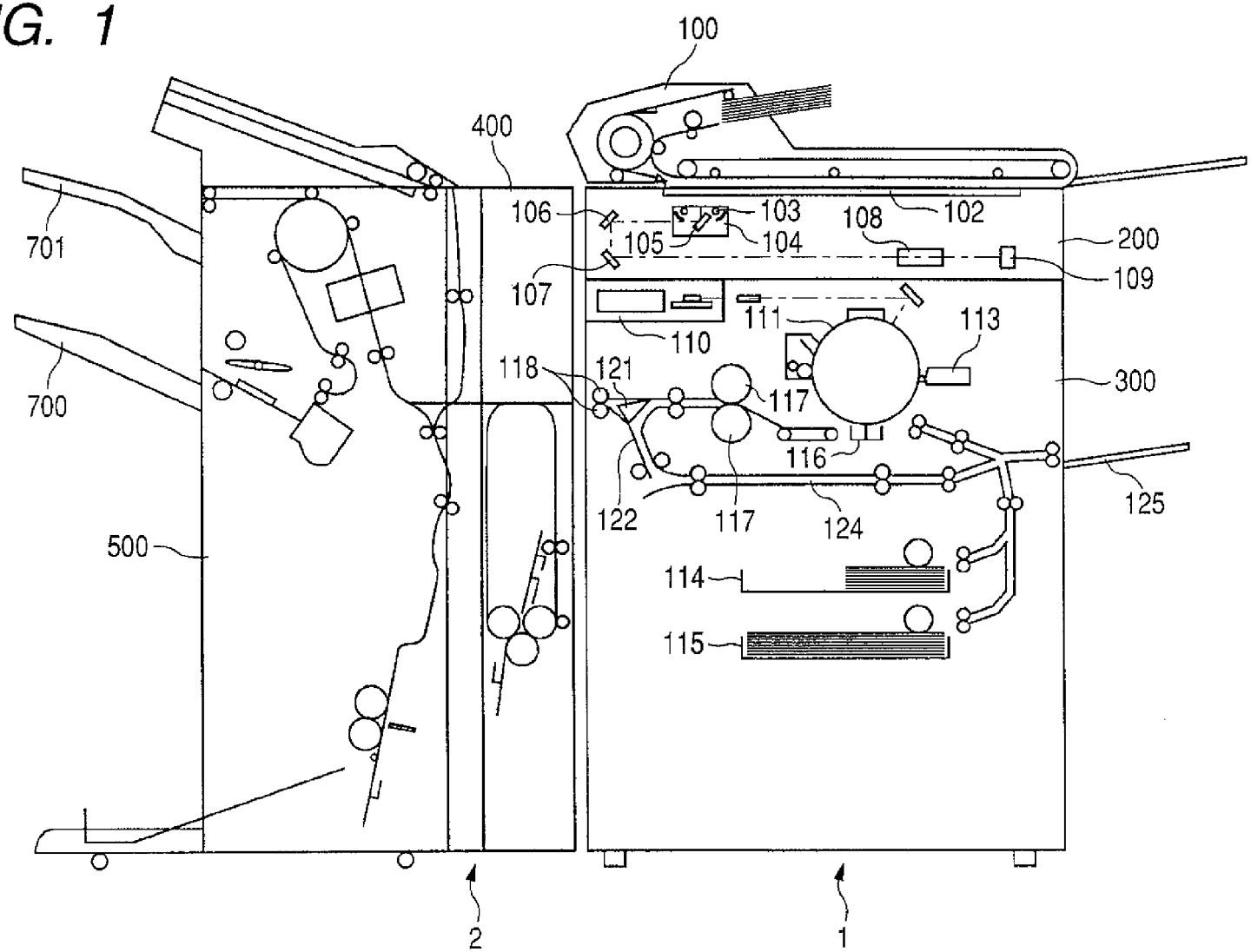
FIG. 1 is a cross-sectional view showing a schematic structure of an image forming system using a sheet processing apparatus according to an embodiment of the present invention.

An embodiment of the present invention will be described in detail with reference to the drawings. FIG. 1 is a cross-sectional view showing a schematic structure of an image forming system using a sheet processing apparatus according to an embodiment of the present invention. As shown in FIG. 1, in the image forming system, a sheet processing apparatus 2 composed of a folding device 400 and a finisher 500 is connected to an image forming apparatus main body 1.

The image forming apparatus main body 1 includes an image reader 200 and a printer 300, and the image reader 200 is mounted with an original feeding apparatus 100. The original feeding apparatus 100 picks up an original to be set one by one from a top page, feeds the picked-up original from left to right on a platen glass plate 102 through a curved path, and then delivers the original to a delivery tray 112.

In this case, a scanner unit 104 is held in a predetermined position, and reads an original image when the original passes on the scanner unit 104 from left to right. A reading method of this case is called an original flow reading. In a process in which the original passes on the scanner unit 104, the original is irradiated with light emitted from a lamp 103 of the scanner unit 104. Reflected light from the original which received the irradiated light enters an image sensor 109 through mirrors 105, 106, and 107, and a lens 108 as image light reflecting the original image. The image sensor 109 photoelectrically converts the entered image light and outputs the converted light as an image signal.

It should be noted that the original fed from the original feeding apparatus 100 is allowed to stop once on the platen glass plate 102, and the scanner unit 104 is moved from left to right, thereby making it possible to read the original image. A reading method of this case is called an original fixed-reading. When the original image is read without using the original feeding apparatus 100, a user sets the original on the platen glass plate 102 by lifting up the original feeding apparatus 100. In this case, the original fixed-reading is performed.

Figure 4:
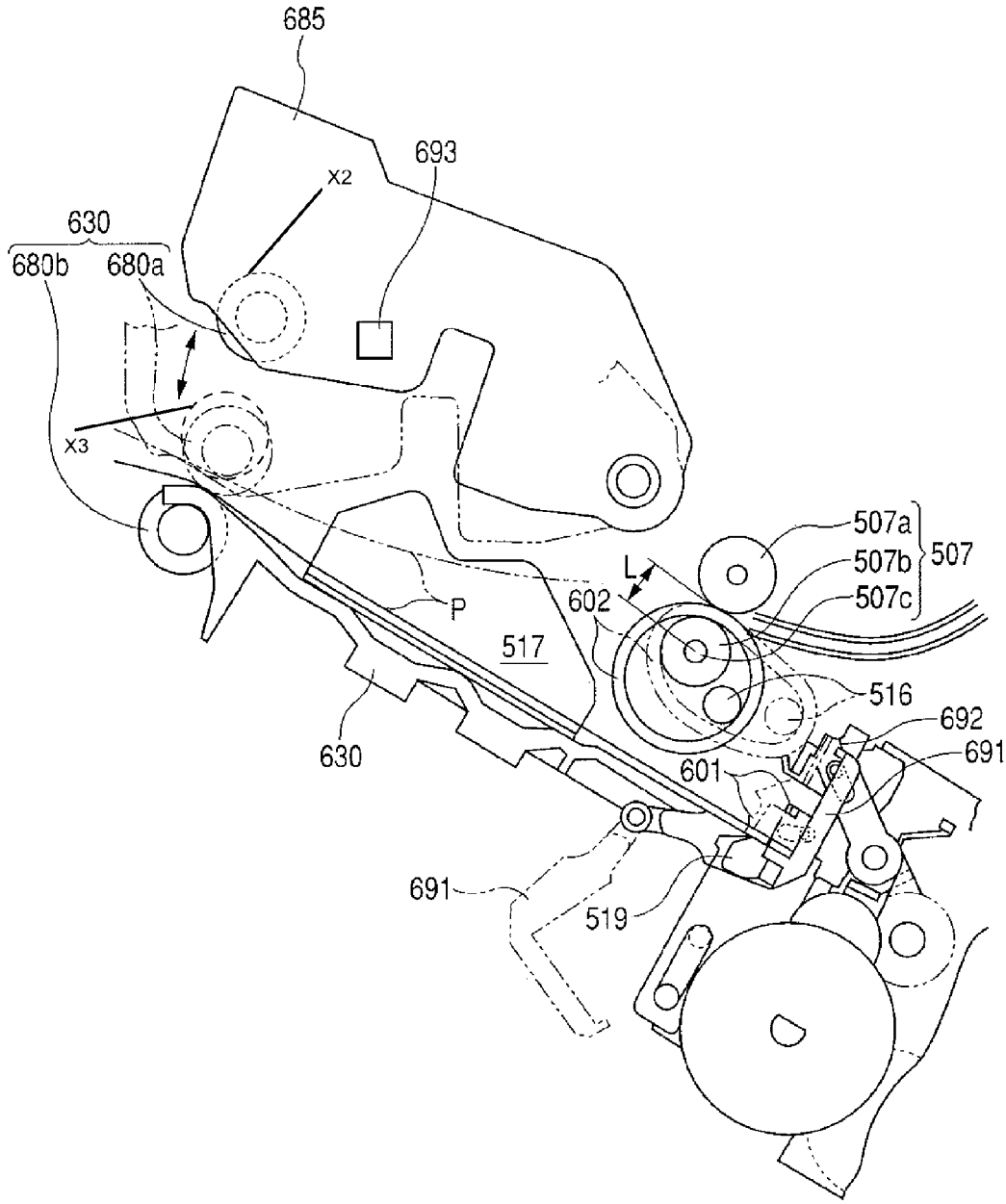
FIG. 4 is a cross-sectional view showing a schematic structure of an intermediate process tray of a finisher serving as a sheet processing apparatus.

The image signal outputted from the image sensor 109 is subjected to an image processing by an image processing part 203 shown in FIG. 4, and then is sent to an exposure control part 110. The exposure control part 110 controls a laser (not shown) so that a laser beam modulated based on the image signal is outputted. The exposure control part 110 also performs a rotation control and the like of a polygon mirror for exposing and scanning a photosensitive drum 111 with a laser beam. By the exposing and scanning with the laser beam, an electrostatic latent image corresponding to the original image is formed on photosensitive drum 111. The electrostatic latent image formed on the photosensitive drum 111 is developed as a toner image by a developing device 113. The toner image formed on the photosensitive drum 111 is transferred onto a sheet by a transferring part 116. The sheet is fed from any one of a cassette 114, a cassette 115, a manual feeding part 125, and a duplex transport path 124.

The sheet subjected to the transferring process of the toner image is transported to a fixing part 117, and the toner image related to the transferring process is fixed on the sheet by the fixing part 117. The sheet subjected to the fixing process is guided to a path 122 once by a flapper 121, and is switched back to be guided to a main body delivery roller 118 by the flapper 121 after a rear end of the sheet has passed through the flapper 121. As a result, the sheet is delivered from the printer 300 by the main body delivery roller 118 in a state where a transfer surface of the toner image faces downward (faces down). A delivery method of this case is called a reverse delivery.

In the case where original images and the like of a plurality of pages are printed out from the top page by delivering the sheets while facing down, it is possible to deliver the sheets in such a manner that the sheets are stacked in order from the top page viewed from a print surface thereof. Note that when an image formation is performed on a hard sheet such as an OHP sheet from the manual feeding part 125, the sheet is delivered by the main body delivery roller 118 in a stare where the printing surface faces upward (faces up) without being guided to the path 122. When an image is formed on both sides of the sheet, the sheet is guided directly from the fixing part 117 to the main body delivery roller 118, and is switched back immediately after the rear end of the sheet has passed through the flapper 121, thereby being guided to the duplex transport path 124 by the flapper 121.

The sheet delivered from the printer 300 is delivered to the folding device 400. The folding device 400 performs a fold process in which the delivered sheet is folded into a Z-shape, and delivers the sheet to the finisher 500. Note that the folding device 400 performs the fold process only in a case where a size of the delivered sheet is A3 size or B4 size and the fold process is designated. In the other cases, the sheet is delivered to the finisher 500 without being folded. The finisher 500 performs a bookbinding process, a staple (stitch) process, a punch (piercing) process, and the like for the sheet delivered from the folding device 400.

Figure 2:
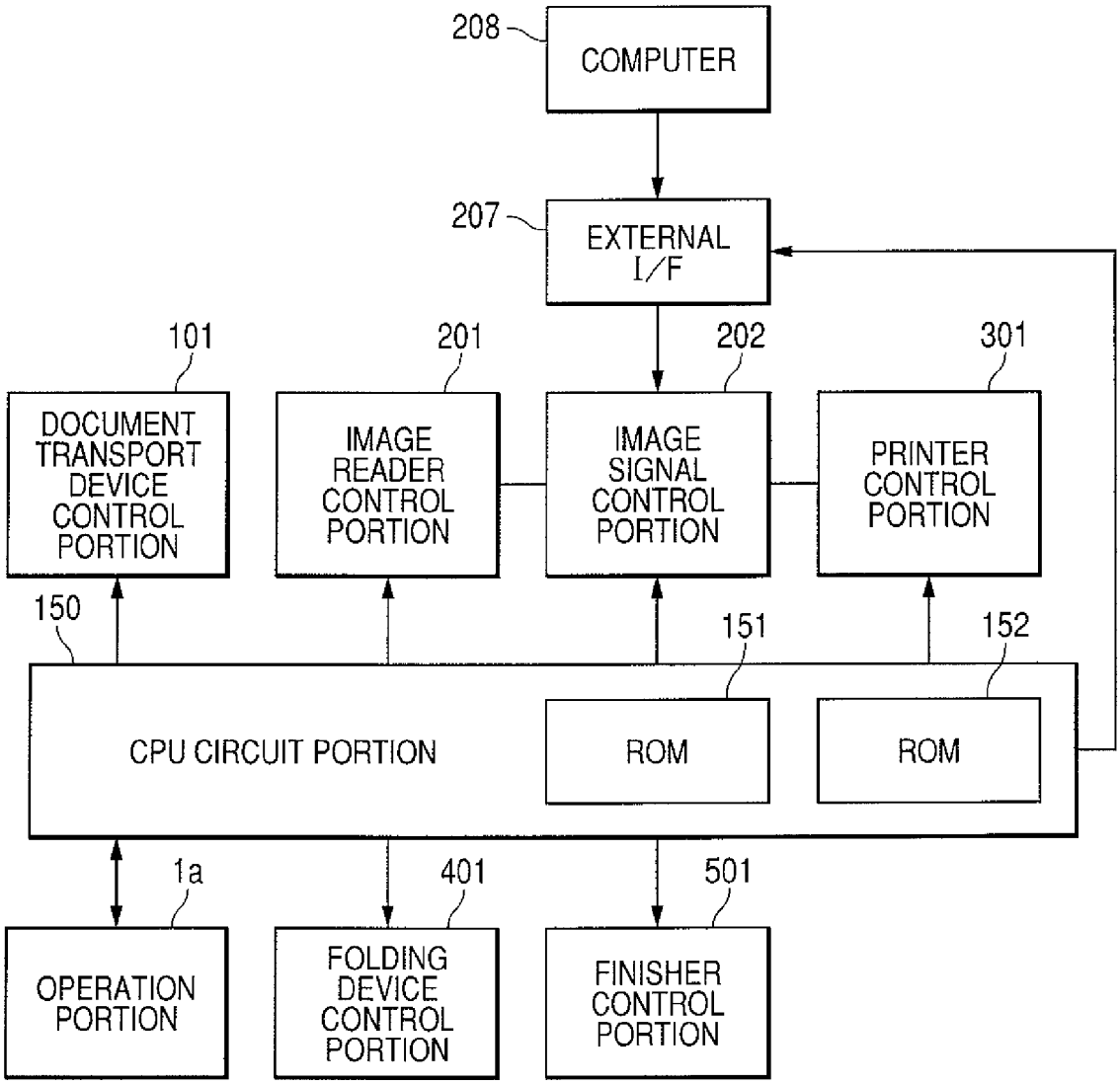
FIG. 2 is a block diagram showing a structure of a control system of the image forming system.

Next, a structure of a control system of the image forming system shown in FIG. 1 will be described with reference to the block diagram of FIG. 2. The image forming system controls a series of image forming processes and the sheet processing using a CPU circuit part 150 as a core. The CPU circuit part 150 is connected to an operating part la, an original feeding apparatus control part 101, an image reader control part 201, an image signal control part 202, a printer control part 301, a folding device control part 401, and a finisher control part 501, respectively. In addition, the image signal control part 202 is connected to a computer 208 through an external I/F, thereby making it possible to taking in image data processed by the computer 208.

The CPU circuit part 150 includes a ROM 151 and a RAM 152 in addition to a CPU (not shown). The CPU circuit part 150 controls the series of image forming processes and the sheet processing while appropriately outputting control signals to the original feeding apparatus control part 101, the image reader control part 201, the image signal control part 202, the printer control part 301, the folding device control part 401, and the finisher control part 501 according to a program stored in the ROM 151 and an operation setting by the operating part 1*a*. Note that the RAM 152 is used as an area for temporarily storing the control data or as a work area for the calculation related to the control.

The original feeding apparatus control part 101 controls the original feeding process performed by the original feeding apparatus 100. The image reader control part 201 controls the reading process of the original image performed by the image reader 200, and the printer control part 301 controls the image forming process performed by the printer 300. The folding device control part 401 controls the sheet fold process performed by the folding device 400, and the finisher control part 501 controls a bookbinding process, a punch process, a staple process, and the like performed by the finisher 500. The image signal read by the image reader 200 is outputted to the printer control part 301 through the image signal control part 202.

It should be noted that the original feeding apparatus control part 101, the image reader control part 201, the image signal control part 202, the printer control part 301, the folding device control part 401, and the finisher control part 501 include a CPU, a ROM, and a RAM in a similar manner as the CPU circuit part 150. The ROM of the finisher control part 501 stores program codes for performing a process according to flowcharts shown in FIGS. 5, 6 and 7, and 9 to be described later.

Next, the sheet processing apparatus 2 will be described with reference to FIG. 3. In this embodiment, the image forming apparatus main body 1 includes the sheet processing apparatus 2 which is composed of the folding device 400 and the finisher 500 to be connected to the image forming apparatus main body 1.

The sheet delivered from the image forming apparatus main body 1 to the folding device 400 is transported to a folding and transporting horizontal path 411. In this case, the sheet is detected by a folding and transporting horizontal path sensor 430. When the sheet is detected, in a case where the fold process is not performed for the sheet, the folding device control part 401 turns off a folding path selection flapper 412, thereby transporting the sheet to the finisher 500 without folding thereof.

In a case where the fold process is performed for the sheet, the folding device control part 401 turns on the folding path selection flapper 412, thereby folding the sheet to be transported to a transporting and folding path 413. After the fold process is completed by a folding roller 414, the folding device control part 401 turns off the folding path selection flapper 412, thereby transporting the sheet to the finisher 500.

The sheet transported to the finisher 500 is first transported into a saddle selection flapper part 515. When a bookbinding process is performed, the finisher control part 501 turns on the saddle selection flapper 515, thereby transporting the sheet to a saddle transporting path 524.

When a punch process, a staple process, and the like are performed, the finisher control part 501 drives the saddle switching flapper 515 so that the sheet is transported in a direction of a punch unit 550 through a transport path 520. Alternatively, when the bookbinding process is performed, the finisher control part 501 drives the saddle switching flapper 515 so that the sheet is transported in a direction of a bookbinding unit 525 through the bookbinding path 524. Note that the other components of the finisher 500 are briefly described herein, and a detailed description thereof will be given later in a process of explaining the punch process, the staple process, and the like.

Reference numeral 503 denotes a transport roller, reference numeral 531 denotes an entrance path sensor, and reference numeral 505 denotes a large transport roller. Reference numeral 509 denotes a pair of delivery rollers which delivers the sheet transported through a transport path 521 onto a sample tray 701. Reference numeral 511 denotes a switching flapper which switches a sheet transport destination to the sample path 521 or a sort path 522. Reference numeral 510 denotes a switching flapper which switches the sheet transport destination to the sort path 522 or a buffer path 523.

Reference numeral 630 denotes an intermediate tray (hereinafter, referred to as "process tray" for receiving sheets temporarily and performing a sort (alignment) process and a staple process. Reference numeral 507 denotes a pair of delivery rollers for delivering sheets as a sheet stack onto a process tray 630, and reference numeral 680 denotes a pair of sheet-stack delivery rollers for delivering the sheet stack received on the process tray 630 onto the stack tray 700. Reference numeral 517 denotes an alignment plate for aligning the sheet stack received on the process tray 630 in a width direction. Reference numeral 603 denotes a drawing paddle for hitting the sheet against a rear end of the process tray 630. Reference numeral 601 denotes a stapler for stitching the sheet stack received on the process tray 630. The stapler 601 is capable of moving in a substantially vertical direction with respect to a sheet transport direction, and moves along an end portion of the sheet, thereby making it possible to perform the staple process such as a two position stitch and the like.

Next, a structure of the process tray 630 will be described with reference to FIG. 4. Between an upper transport roller 507*a* and a lower transport roller 507*b* of a pair of transport rollers 507, a knurling belt 602 is mounted. The knurling belt 602 is composed of elastic deformable members made of rubber and resin, respectively, and has a larger diameter than that of the lower transport roller 507*b*. The sheet is nipped between the knurling belt 602 and the upper transport roller 507*a* to be delivered onto the process tray 630. As indicated by the alternate long and two short dashes line, a distance L between a surface where the knurling belt 602 is in contact with the upper transport roller 507*a* and a rotation center 507*c* of the lower transport roller 507*b* is set such that a sheet P is thrown at a targeted conveying speed to land on the process tray 630 in a predetermined position.

Figure 3:
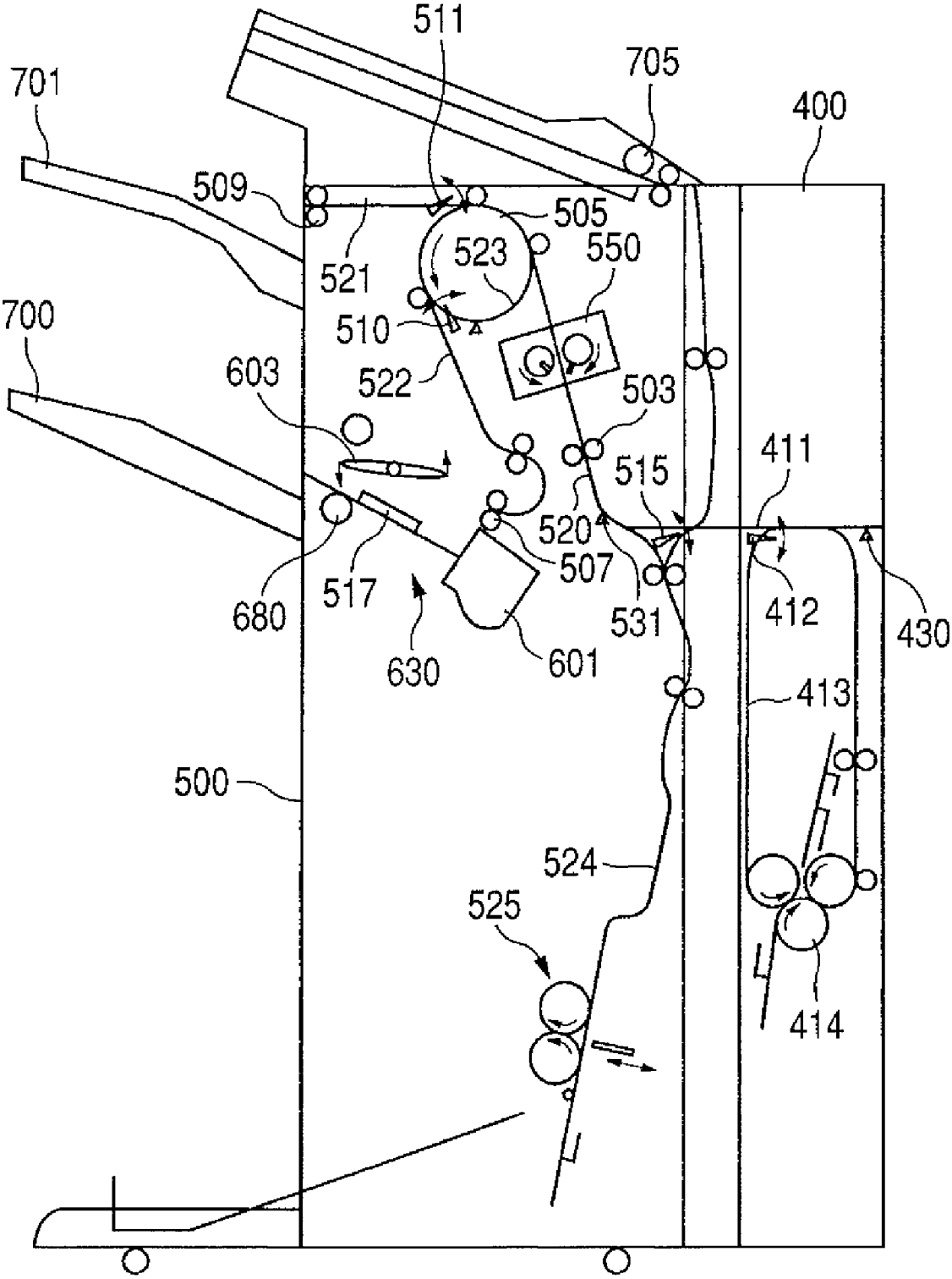
FIG. 3 is a cross-sectional view showing a schematic structure of the sheet processing apparatus.

The rear end portion of the process tray 630, in other words, a portion close to the folding device 400 which is located on a right side of FIG. 3, is positioned lower than a leading end portion of the process tray 630. Thus, the sheet P delivered onto the process tray 630 recedes to the rear end side of the process tray 630 as indicated by the solid line, to be received by a rear end stopper 691. Note that, as described later, the sheet is actually allowed to hit against the rear end stopper 691 forcibly by the drawing paddle 603 or through a reverse rotation of the pair of sheet-stack delivery rollers 680 to thereby perform an alignment of the rear end portion of the sheet stack.

While the sheet is received on the process tray 630, a pair of the alignment plates 517 (one of which is not shown) is repeatedly brought into contact with and spaced apart from the sheet from both sides in a width direction of the sheet, thereby performing the alignment of the sheet stack in the width direction thereof.

When the sheet stack on the process tray 630 reaches a predetermined thickness, a lower part of the knurling belt 602 interrupts the sheet receding toward the rear end stopper 691. As a result, as indicated by the alternate long and two short dashes line of FIG. 4, the knurling belt 602 is pulled and deformed to be flattened when the displacement roller 516 is displaced.

When the staple process is performed, the rear end stopper 691 is rotated as indicated by the alternate long and two short dashes line of FIG. 4 so as not to interrupt the staple operation. The stapler 601 approaches an anvil 519, and the stapler 601 and the anvil 519 nip the sheet stack to thereby stitch the sheet stack by a staple 692.

The sheet stack subjected to a stitch process is delivered onto the stack tray 700 or the sample tray 701 by a rotation of the knurling belt 602 which is restored to its original circular shape by the further displacement of the displacement roller 516, and a rotation of the pair of sheet-stack delivery rollers 680 which descends to approach the process tray 630.

It should be noted that the upper delivery roller 680a of the pair of sheet-stack delivery rollers 680 is moved up and down by a rotation of a rocking guide 685 to be brought into contact with and spaced apart from the lower delivery roller 680*b*. A nipping force of the sheet stack is controlled by a drive mechanism (not shown) of the rocking guide 685. To be specific, the rocking guide 685 is driven by a stepping motor, is moved in a direction in which the upper delivery roller 680*a* is opened by a normal rotation of the motor, and is moved in a direction in which the upper delivery roller 680*a* is closed by a reverse rotation of the motor. In this case, the stepping motor is controlled to be driven such that the nipping force of the sheet stack by the pair of sheet-stack delivery rollers 680 is set to be constant irrespective of the thickness of the sheet stack. In other words, the position of the upper delivery roller 680*a* in a case of the sheet-stack containing 3 sheets differs from that in a case of the sheet-stack containing 100 sheets, but the stepping motor is controlled to be driven such that the force of nipping the sheet stack is set to be constant.

When the sheet stack is delivered from the process tray 630, the upper delivery roller 680*a* is returned to a position indicated by the solid line of a direction in which the upper delivery roller 680*a* moves away from the process tray 630, in preparation for the series of processes for a group of sheets related to a subsequent sheet stack, and the rear end stopper 691 is also returned to the position indicated by the solid line.

Next, a puddle operation performed when a first sheet group of sheet groups is delivered onto the process tray 630 will be described. It should be noted that the sheet is referred to as "sheet group", because the sheet to be delivered onto the process tray 630 is not always one, but there is also a case where a plurality of sheets are overlapped to be delivered. In other words, even when the sheet is referred to as "sheet group", there is a case where the sheet is only one.

In the alignment operation, when the sheet group is delivered onto the process tray 630, the pair of sheet-stack delivery rollers 680 is normally in an opened state. Accordingly, it is not possible that the sheet group which is thrown onto the process tray 630 by the rotations of the pair of delivery rollers 507 and the knurling belt 602 is pushed back toward the rear end stopper 691 by the pair of sheet-stack delivery rollers 680. As a result, every time the sheet group is delivered onto the process tray 630, the drawing paddle 603 shown in FIG. 3 is rotated, thereby pushing back the sheet group thrown onto the process tray 630 in a direction of the rear end stopper 691.

However, when the first sheet group related to the sheet stack to be stapled is delivered onto the process tray 630, the pair of sheet-stack delivery rollers 680 is in a closed state. Accordingly, in a case where the first sheet group is delivered onto the process tray 630, the first sheet group is allowed to hit against the rear end stopper 691 by driving the pair of sheet-stack delivery rollers 680 to be rotated in a reverse direction by a predetermined amount. In this case, the drawing paddle 603 is stopped. After that, the pair of sheet-stack delivery rollers 680 is in a closed state, and the alignment in a width direction of the sheet group is performed by the alignment plate 517.

Further, the pair of sheet-stack delivery rollers 680 is maintained in the opened state until when the sheet group related to the sheet stack to be stapled is completely delivered onto the process tray 630. Thus, when a second and subsequent sheet groups are delivered onto the process tray 630, the sheet groups are allowed to hit against the rear end stopper 691 by the drawing paddle 603. As described above, the drawing paddle 603 operates on the second and the subsequent sheet groups and does not operate on the first sheet group, thereby making it possible to reduce the number of operations and suppress friction.

It should be noted that in a case where a plurality of sheets are stored in the buffer path 523, and the plurality of sheets are simultaneously delivered onto the process tray 630, the drawing paddle 603 is not allowed to operate when the first sheet group stored in the buffer path 523 is delivered onto the process tray 630.

This is because, in a case where the sheet group is to hit against the rear end stopper 691 only by the drawing paddle 603 when the buffered sheet group is received on the process tray 630, only an upper sheet of the sheet group is allowed to hit against the rear end stopper 691, and a lower sheet of the sheet group is not allowed to hit against the rear end stopper 691 when a coefficient of friction between the plurality of sheets is small. To avoid such the failure, the pair of sheet-stack delivery rollers 680 is rotated in a reverse direction in a state where the sheet group is nipped by the pair of sheet-stack delivery rollers 680, thereby also allowing the lower sheet of the sheet group to hit against the rear end stopper 691.

Next, a standby position of the upper delivery roller 680*a* of the pair of sheet-stack delivery rollers 680 will be briefly described. The standby position of the upper delivery roller 680*a* is set so that a plurality of standby positions may be additionally set between a maximum separation position (corresponding to a position indicated by the dotted line of FIG. 4) and a contact position with the sheet stack (corresponding to a position indicated by the alternate long and two short dashes line of FIG. 4). A selection process of the standby positions will be described later.

Next, a control process of the finisher will be described with reference to the flowchart. First, an operation mode discrimination process will be described with reference to the flowchart of FIG. 5.

When a start signal or the like of the finisher process is transmitted from the CPU circuit part 150 (Step S1), the finisher control part 501 starts driving an entrance motor, a buffer motor, and a delivery motor (not shown) in the finisher 500 (Step S2).

It is assumed that the start signal contains various information which is necessary for the operation mode and the staple process such as the number of sheet stacks to be stapled and the number of sheet stacks (i.e., number of copies). However, the various information necessary for the staple process such as the number of sheet stacks (i.e., number of copies) may be transmitted to the finisher control part 501 from the CPU circuit part 150 prior to the start signal of the finisher process when the image forming process is started, for example.

Next, the finisher control part 501 discriminates operation mode information included in the various information (Step S3). The finisher control part 501 performs a control of a non-sort process when the operation mode information is a non-sort mode (Step S4), performs a control of a sort process when the operation mode information is a sort mode (Step S5), and performs a control of a staple sort process when the operation mode information is a staple sort mode (Step S6).

Upon completing any one of the above-mentioned processes, the finisher control part 501 stops driving the entrance motor, the buffer motor, and the delivery motor (not shown) within the finisher 500 (Step S7), and returns to the standby state of Step S1.

Next, the staple sort process of Step S6 shown in FIG. 5 will be described in detail with reference to the flowchart of FIG. 6.

Upon starting the staple process, the finisher control part 501 first drives the switching flapper 511 to guide the sheet in a direction of the process tray 630 (Step S301). In this case, the finisher control part 501 switches the switching flapper 515 in advance so as to select the transport path 520 without selecting the bookbinding path 524 because the bookbinding process is not performed therein.

Next, the finisher control part 501 discriminates whether or not the start signal of the finisher process sent from the CPU circuit part 150 is turned on (Step S302). As a result, when the start signal is turned on, the finisher control part 501 discriminates whether or not the entrance path sensor 531 is turned on, to thereby discriminate whether or not the sheet is delivered from the folding device 400 (Step S303).

When the sheet is delivered from the folding device 400, the finisher control part 501 starts a sheet sorting sequence process (Step S304). The sheet sorting sequence process is assigned to every sheet, and is performed by a program in multitasking. In the sheet sorting sequence process, a buffering process in which the buffer path 523 is selected to temporarily hold the sheet is performed by switching the switching flapper 510 appropriately, and a delivery process in which the sheet within the buffer path 523 and the subsequent sheets are simultaneously delivered onto the process tray 630 is performed by selecting the sort path 522.

In the sheet sorting sequence process, the staple process for the sheet stack received on the process tray 630, and a sheet-stack delivery operation discrimination process which is described later are also performed. Note that the buffering process for the sheet is performed to allow a margin in terms of time necessary for a process at a downstream side, and is not performed for the first several sheets.

The finisher control part 501 starts the sheet sorting sequence process in Step S304, and then discriminates whether or not the entrance path sensor 531 is turned off, to thereby discriminate whether or not the rear end of the sheet has passed through the position of the entrance path sensor 531 (Step S305).

In a case where the rear end of the sheet has passed through the position of the entrance path sensor 531, the finisher control part 501 returns to Step S302 to discriminate whether or not the start signal is turned on. On the other hand, in a case where the rear end of the sheet has not passed through the position of the entrance path sensor 531, the finisher control part 501 returns to Step S304 to continue the sheet sorting sequence process.

Figure 5:
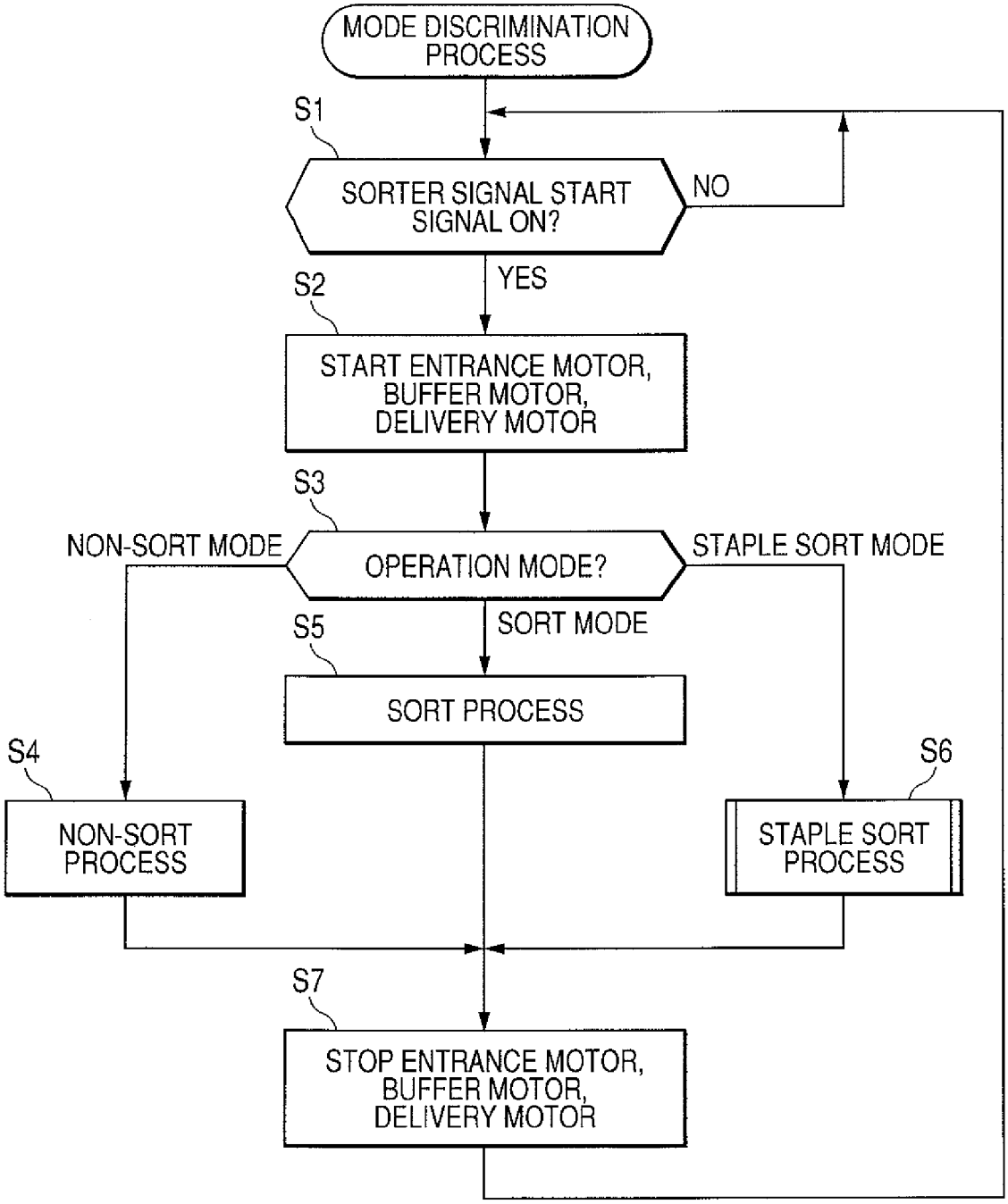
FIG. 5 is a flowchart showing a mode discrimination process performed by the finisher.
Figure 6:
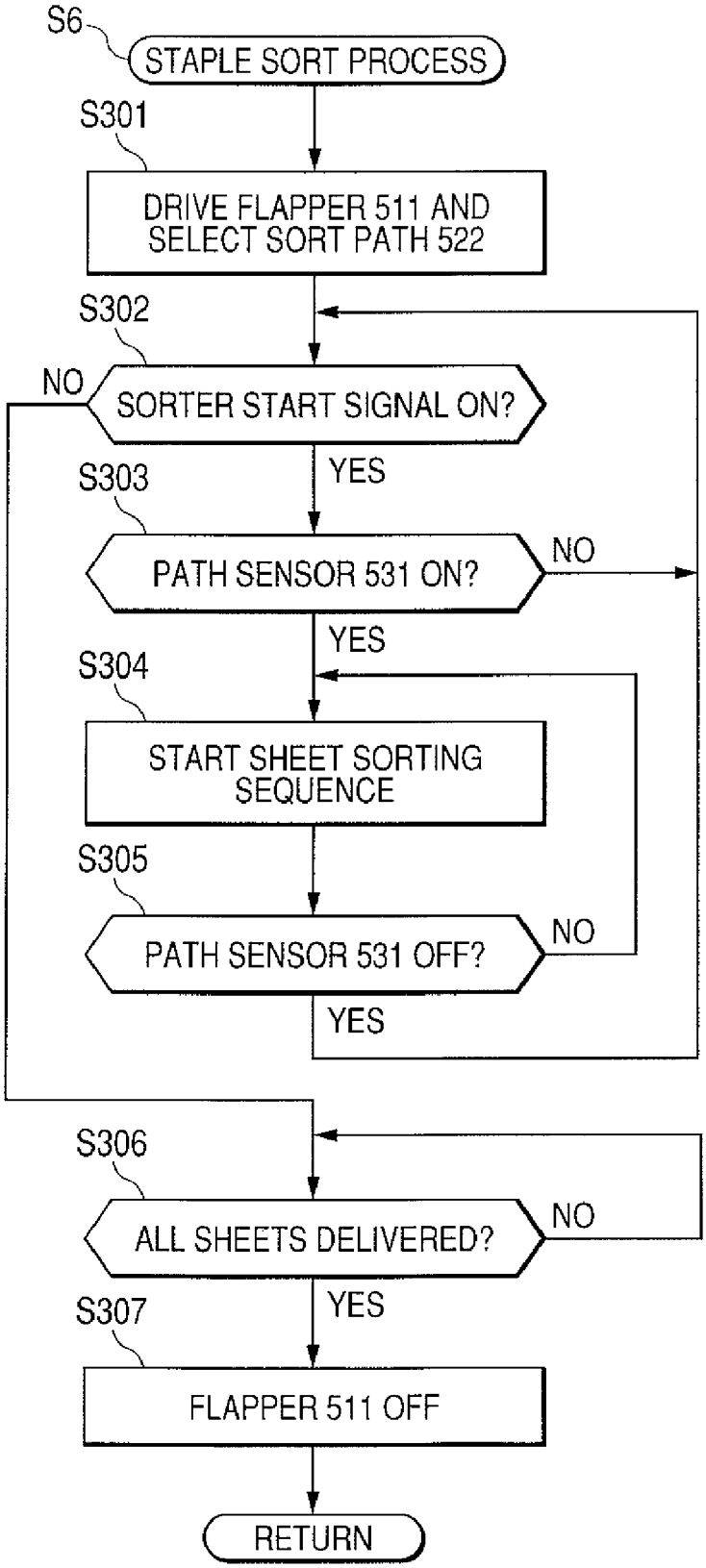
FIG. 6 is a flowchart showing a staple sort process performed by the finisher.

In Step S302, in a case where it is discriminated that the start signal is turned off, the finisher control part 501 completes delivering all the sheets to the process tray 630, and then switches the switching flapper 511 in another direction (Steps S306 and S307) to return to the flow of FIG. 5.

Figure 7:
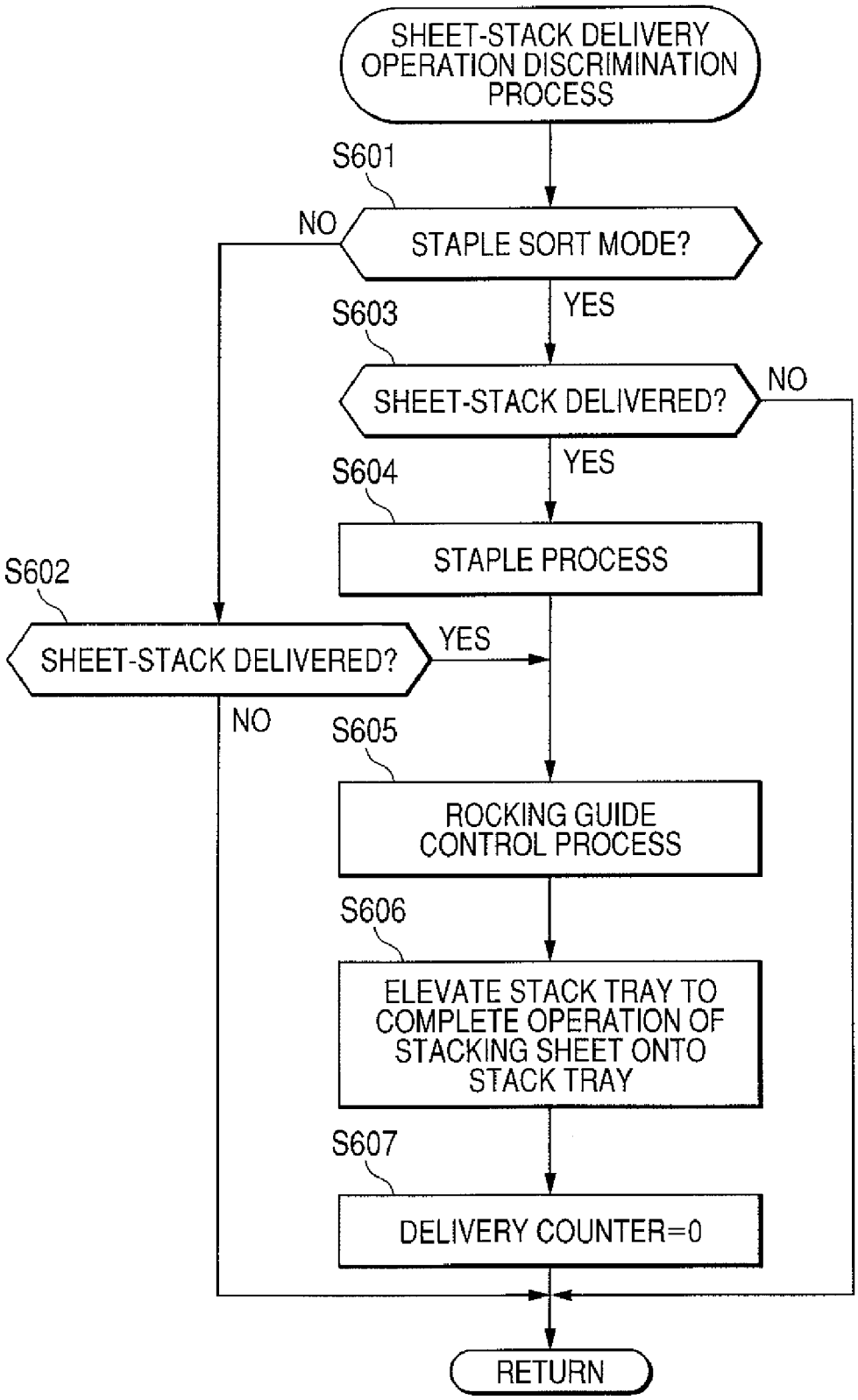
FIG. 7 is a flowchart showing a sheet-stack delivery operation discrimination process performed by the finisher.

Next, the sheet-stack delivery operation discrimination process performed in the process of the sheet sorting sequence process will be described with reference to the flowchart of FIG. 7.

In the sheet-stack delivery operation discrimination process, the finisher control part 501 first determines whether or not the operation mode is the staple mode (Step S601). As a result, when it is determined that the operation mode is not the staple mode, the finisher control part 501 discriminates whether or not the sheet delivered onto the process tray 630 is a plurality of sheets, in other words, a sheet group related to the sheet-stack delivery (Step S602). When it is determined that the sheet is the sheet group related to the sheet-stack delivery in Step S602, the finisher control part 501 proceeds to Step S605 to be described later. When it is determined that the sheet is not the sheet group related to the sheet-stack delivery, the finisher control part 501 returns to the flow of the sheet sorting sequence process.

Further, when it is determined that the operation mode is the staple mode in Step S601, the finisher control part 501 discriminates whether or not the sheet delivered onto the process tray 630 is a plurality of sheets, in other words, the sheet group related to the sheet-stack delivery (Step S603). When it is determined that the sheet is not the sheet group related to the sheet-stack delivery in Step S603, the finisher control part 501 returns to the flow of the sheet sorting sequence process.

On the other hand, when it is determined that the sheet is the sheet group related to the sheet-stack delivery in Step S603, the finisher control part 501 performs the staple process for the sheet group on the process tray 630 to form a sheet stack (Step S604), and proceeds to Step S605.

In Step S605, the finisher control part 501 rotates the rocking guide 685, thereby performing the rocking guide control process in which the upper delivery roller 680*a* of the pair of sheet-stack delivery rollers 680 is brought into contact with the sheet stack on the process tray 630 to deliver the sheet stack onto the stack tray 700 (Step S605).

Figure 9:
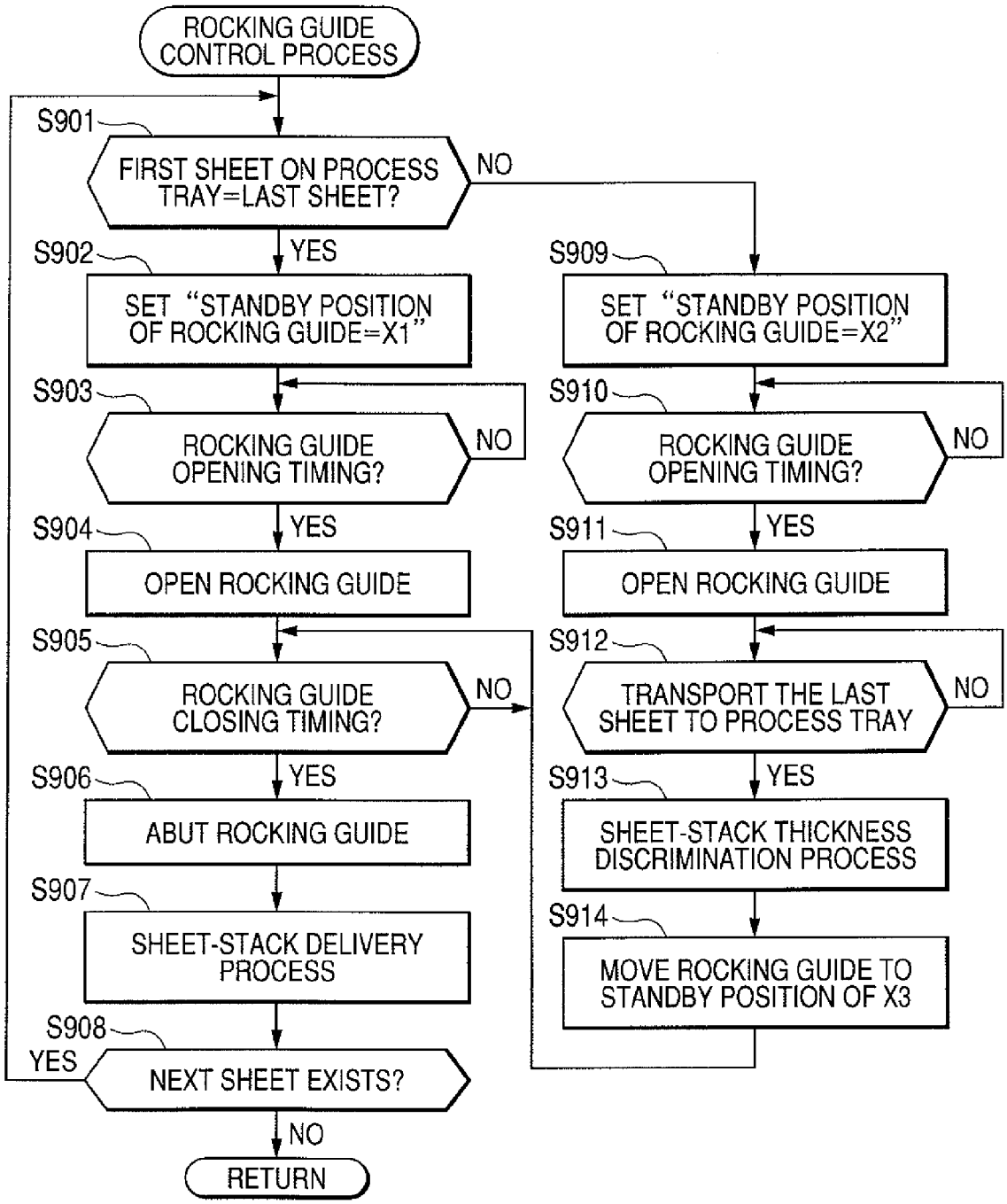
FIG. 9 is a flowchart showing a rocking guide control process performed by the finisher.

The rocking guide control process will be described in detail with reference to the flowchart of FIG. 9. Note that, in the flowchart of FIG. 7, the staple process of Step S604 and the rocking guide control process of Step S605 are described as completely different processes for convenience, but a part of the rocking guide control process is executed as a part of the staple process. In addition, a part of the rocking guide control process is executed also as a part of the sheet sorting sequence process of Step S304 shown in FIG. 6.

Next, the finisher control part 501 raises and lowers the stack tray 700 to complete the operation of receiving the sheet stack onto the stack tray 700 (Step S606). Then, the finisher control part 501 resets a delivery counter to "0" which has been counted up every time one sheet is delivered onto the process tray 630 in the sheet sorting sequence process (Step S607), and returns to the sheet sorting sequence process.

It should be noted that the number of sheets which is counted by the delivery counter is used as data for determining the thickness of the sheet stack as described later.

Next, prior to a description as to the rocking guide control process, a description as to a delivery method of the sheet onto the process tray 630 will be given by taking cases where the number of sheets per stack is three and five as examples.

Figure 8A:
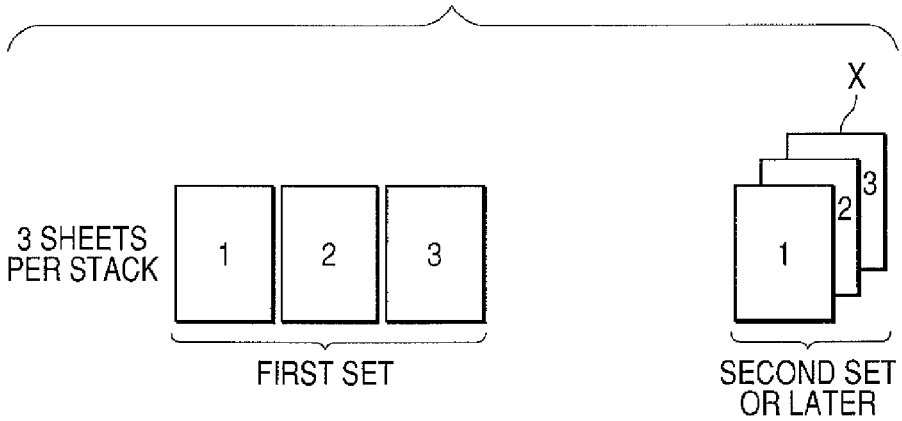
FIG. 8A is an explanatory diagram of a sheet delivery process to the intermediate process tray performed by the finisher.

As shown in FIG. 8A, in a case where the number of sheets per stack is three, each sheet of a first set is not buffered in the buffer path 523, and is delivered onto the process tray 630 one by one. Each sheet of a second set is appropriately subjected to a buffering process to gain time for the staple process for the sheet stack of the first set or for the delivery process onto the stack tray 700.

To be specific, in this embodiment, the number of sheets to be buffered in the buffer path 523 is set to two, and the buffered first sheet and second sheet of the second set and a third sheet of the second set transported thereafter are overlapped to be simultaneously delivered onto the process tray 630 (see reference symbol X of FIG. 8). A control is performed for sheets of a third set and subsequent sets in the same manner as in the sheet of the second set.

Figure 8B:
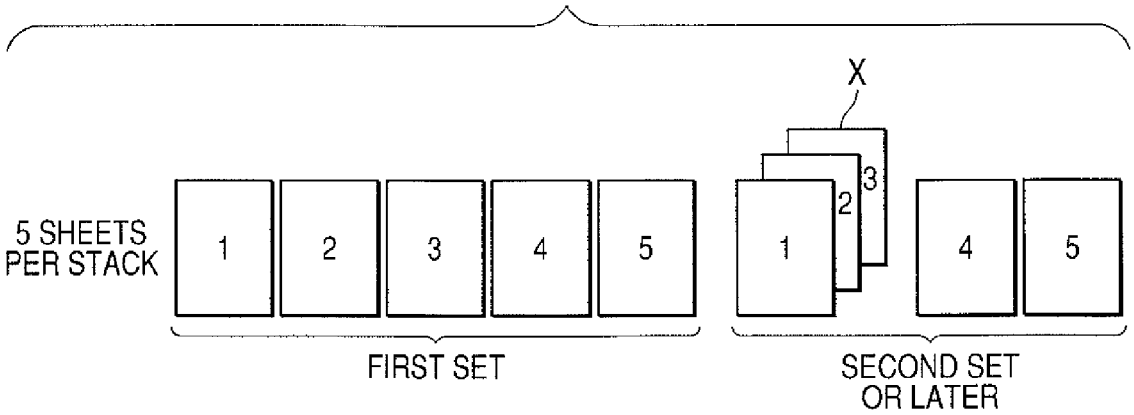
FIG. 8B is an explanatory diagram of a sheet delivery process to the intermediate process tray performed by the finisher.

As shown in FIG. 8B, also in a case where the number of sheets per stack is five, five sheets of the first set are not buffered in the buffer path 523, and are delivered onto the process tray 630 one by one for the same reason as in the case where the number of sheets per stack is three.

Five sheets of the second and subsequent sets are appropriately subjected to the buffering process to gain time for the staple process for the sheet stack of the first set or for the delivery process onto the stack tray 700. In other words, as in the process for the second set in the case where the number of sheets per stack is three, the first and second sheets of the second set are buffered in the buffer path 523 and are simultaneously delivered onto the process tray 630 in a state where the two sheets and the third sheet of the second set which is transported thereafter are overlapped with each other. Then, the fourth and fifth sheets of the second set are delivered onto the process tray 630 one by one without being buffered. The sheets of the third and subsequent sets are controlled in the same manner as in the sheet of the second set.

Next, the rocking guide control process will be described in detail with reference to a flowchart shown in FIG. 9 (and with continued reference to FIG. 4). In the rocking guide control process, the finisher 501 first discriminates whether or not the first sheet delivered onto the process tray 630 is the last sheet related to the sheet stack (Step S901).

It should be noted that the "first sheet" means a sheet which is to be first delivered onto the process tray 630. As the first sheet to be delivered, there are a case where the number of sheets per stack is one, and a case where the number of sheets per stack is two or three which are buffered and then overlapped with each other to be transported.

For example, the first sheet of the second set in the case where the number of sheets per stack is three is the sheet which is first delivered onto the process tray 630, because the three sheets are overlapped with each other to be transported to the process tray 630 as described above. The first sheet of the second set in the case where the number of sheets per stack is three is the last sheet related to the sheet stack. As a result, it is discriminated that the first sheet of the second set in the case where the number of sheets per stack is three is the last sheet related to the sheet stack in Step S901.

In addition, for example, as shown in FIG. 8B, the second to fourth sheets of the first set are the sheets which are first delivered onto the process tray 630, that is, the second to fourth sheets are neither the first sheet nor the last sheet related to the sheet stack. Thus, it is discriminated that the first sheet is not the last sheet related to the sheet stack in Step S901.

In Step S901, when it is discriminated that the first sheet is the last sheet related to the sheet stack, the finisher control part 501 sets a standby position of the rocking guide 685, that is, a standby position of the upper delivery roller 680*a* of the pair of sheet-stack delivery rollers 680, as X1 (Step S902). The standby position X1 is a standby position set between the maximum separation position of the upper delivery roller 680*a* of the pair of sheet-stack delivery rollers 680 and a position where the upper delivery roller 680*a* is brought into contact with the sheet stack. In this embodiment, the standby position X1 is set to a position which is spaced apart from the position where the upper delivery roller 680*a* is brought into contact with the sheet stack by a small distance.

The standby position X1 is set by assuming the following situation. That is, as described above, the first sheet to be delivered onto the process tray 630 allows the rear end of the sheet to hit against the rear end stopper 691 by rotating the pair of sheet-stack delivery rollers 680 in a reverse direction by a predetermined amount after the rear end of the sheet has fallen onto the process tray 630. After that, the sheet is aligned in a vertical direction with respect to the sheet transport direction. However, when the sheets are held to be nipped by the pair of sheet-stack delivery rollers 680, wrinkles of the sheets may be caused in the alignment process.

Therefore, it is necessary to open the pair of sheet-stack delivery rollers 680, and after the alignment process is finished (after the staple process in the staple mode), it is necessary to close the pair of sheet-stack delivery rollers 680 in preparation for the sheets to be delivered onto the stack tray 700. As a result, the standby position X1 is set to the position which is spaced apart from the position where the upper delivery roller 680*a* is brought into contact with the sheet stack by a small distance so that the upper delivery roller 680*a* is immediately brought into contact with the sheet stack after being separated from the sheet stack.

Next, at a timing of opening the pair of sheet-stack delivery rollers 680 (Step S903), the finisher control part 501 moves the upper delivery roller 680*a* to the standby position X1 (Step S904). Then, at a timing of closing the pair of sheet-stack delivery rollers 680 (Step S905), the finisher control part 501 allows the upper delivery roller 680*a* to be brought into contact with the sheet stack on the process tray 630 to nip the sheet stack (Step S906).

Next, the finisher control part 501 allows the sheet stack on the process tray 630 to be delivered onto the stack tray 700 by rotating the pair of sheet-stack delivery rollers 680 in a forward direction (Step S907). When there is a subsequent sheet to be delivered onto the process tray 630 (Step S908), the finisher control part 501 returns to Step S901, and when there is no subsequent sheet to be delivered onto the process tray 630 (Step S908), the finishing control part 501 returns to the flow shown in FIG. 7.

In Step S901, when it is discriminated that the first sheet to be delivered onto the process tray 630 is not the last sheet related to the sheet stack, that is, when the number of sheets per stack is equal to or more than four or the like, the finisher control part 501 sets the standby position of the upper delivery roller 680*a* to an opening position X2 (Step S909, see dotted lines of FIGS. 8A and 8B). The second and subsequent sheets to be delivered onto the process tray 630 are allowed to hit against the rear end stopper 691 by the drawing paddle 603, so the opening position X2 is set as the maximum opening position so as not to interrupt the rotation of the drawing paddle 603.

Next, at a timing of opening the pair of sheet-stack delivery rollers 680 (Step S910), the finisher control part 501 moves the upper delivery roller 680*a* to the maximum standby position X2 (Step S911). Then, the finisher control part 501 waits until the last sheet related to the sheet stack is delivered onto the process tray 630 (Step S912) and discriminates a thickness of the sheet stack on the process tray 630 (Step S913). In this embodiment, the sheet-stack thickness discrimination process is performed by using the number of sheets to be delivered which is counted by the delivery counter.

Next, the finisher control part 501 moves the upper delivery roller 680*a* to a standby position X3 according to the calculated thickness of the sheet stack (Step S914) and advances to Step S905. The standby position X3 is set so that the upper delivery roller 680*a* is spaced apart from the sheet stack to perform the alignment process for the sheet stack after the last sheet is delivered onto the process tray 630, and then the upper delivery roller 680*a* is brought into contact with the sheet stack when the sheet stack is delivered from the process tray 630 onto the stack tray 700.

In this embodiment, the standby position X3 is set to a position where a distance between the upper surface of the sheet stack and the upper delivery roller 680*a* becomes a predetermined small distance without interrupting the alignment process. As a result, when the sheet stack is delivered from the process tray 630 onto the stack tray 700, it is possible to bring the upper delivery roller 680*a* into contact with the sheet stack swiftly to speed up the delivery process for the sheet stack from the intermediate process tray 630.

As described above, in the case where the upper surface of the sheet stack is spaced apart from the upper delivery roller 680*a* by a small distance, when the pair of sheet-stack delivery rollers 680 is closed to nip the sheet stack, there is no possibility to raise a problem in that the pair of sheet-stack delivery rollers 680 to cause vibration or noise. Note that, as is assumed from the above description, the distance between the upper surface of the sheet stack and the upper delivery roller 680*a* is constant. However, the standby position X3 itself changes according to the thickness of the sheet stack.

It should be noted that the present invention is not limited to the embodiment as described above. For example, the sheet-stack thickness discrimination process is performed by using only the number of sheets per stack to be received on the process tray 630. However, the thickness of the sheet stack may be discriminated by other methods described below.

For example, the thickness of the sheet stack may be determined based on the number of sheets per stack to be received on the process tray 630 and sheet attribute information inputted from the operating part la of the image forming apparatus main body 1. The sheet attribution information which can be inputted from the operating part 1*a* may contain a sheet type such as thick paper, extremely thick paper, thin paper, and an OHP sheet, and a thickness of one sheet.

In addition, a sensor for measuring a thickness of a single sheet may be provided in the sheet transport path from the image forming apparatus main body 1 to the process tray 630 to perform actual measurement of the thickness of the sheet to be delivered. A detailed description as to the sensor will be omitted because the sensor is well known. The thickness of the sheet may be also discriminated based on a movement of a movable core by allowing the sheet to pass between a magnetic sensor provided in the sheet transport path and the movable core. Alternatively, it is possible to discriminate the thickness of the sheet by allowing the sheet to pass through the predetermined pair of rollers to measure a displacement of the pair of rollers when the sheet passes therebetween.

Further, it is possible to measure the thickness of the sheet stack per stack which is received on the process tray 630. As shown in FIG. 4, it is also possible that a distance measurement sensor 693 is provided on the rocking guide 685 or the like, and a distance from the bottom to the upper surface of the sheet stack which is received on the process tray 630 by the distance measurement sensor 693 to calculate the thickness of the sheet stack based on the measured value.

Further, the object of the present invention is also achieved by providing a system or an apparatus with a recording medium on which a program code of software for realizing a function of the embodiment is recorded, and by reading and executing the program code stored in the recording medium by the system or a computer of the apparatus (or a CPU, an MPU, or the like).

In this case, the program code itself, which is read from the recording medium, realize the function of the embodiment described above. As a result, the program code and the recording medium on which the program code is recorded constitute the present invention.

For the recording medium for supplying the program code, a floppy (registered trademark) disk, a hard disk, a magneto-optical disk, a CD-ROM, a CD-R, a CD-RW, a DVD-ROM, a DVD-RAM, a DVD-RW, a DVD+RW, magnetic tape, a non-volatile memory card, a ROM, and the like may be used. Alternatively, it is possible to download the program code through a network.

By executing the program code read by the computer, the function of the embodiment described above is realized, and in addition, an operating system (i.e., OS) or the like running on the computer carries out a part of or all of the actual process based on an instruction of the program code, which also realizes the function of the embodiment described above.

Further, the program code read from the recording medium is written in the memory which is provided to a function expansion board inserted into the computer or a function expansion unit connected to the computer, and then the function expansion board or a CPU or the like provided to the function expansion unit performs a part of or all of the actual process based on the instruction of the program code, which also realizes the function of the embodiment described above.

According to the embodiment, it is possible to provide the sheet processing apparatus capable of speeding up the delivery process of the sheet stack from the intermediate process tray without causing any new problems such as vibration and noise.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-248159, filed Aug. 29, 2005, which is hereby incorporated by reference herein in its entirety.

What is claimed is:

1. A sheet processing apparatus connected to an image forming apparatus, comprising:

an intermediate process tray which receives sheets delivered from the image forming apparatus;

a process unit which applies a predetermined process for the sheet stack received on the intermediate process tray;

a pair of rollers which nips and delivers the sheets as a sheet stack subjected to the predetermined process by the process unit;

a stack tray which receives the sheet stack delivered by the pair of rollers; and a controller which positions one roller of the pair of rollers to a first standby position, after a last sheet of the sheet stack is delivered onto the intermediate process tray and while the process unit applies the predetermined process, so that the one roller of the pair of rollers does not contact the sheet stack in the first standby position;

wherein the first standby position corresponds to a thickness of the sheet stack to be delivered onto the stack tray;

wherein the controller causes the one roller of the pair of rollers to contact the sheet stack after the process unit applies the predetermined process; and wherein until the last sheet of the sheet stack is delivered onto the intermediate process tray the controller positions the one roller of the pair of rollers to a second standby position where an opening amount of the pair of rollers is larger than that the one of the pair of rollers is in the first standby position.

2. The sheet processing apparatus according to claim 1, wherein the controller calculates the number of sheets to be delivered onto the intermediate process tray to discriminate the thickness of the sheet stack based on the calculated number of sheets.

3. The sheet processing apparatus according to claim 2, wherein the controller discriminates the thickness of the sheet stack based on the calculated number of sheets and a thickness of one sheet of the sheets.

4. The sheet processing apparatus according to claim 3, wherein the image forming apparatus provides information on the thickness of the one sheet.

5. The sheet processing apparatus according to claim 2, further comprising a sheet thickness sensor which detects a thickness of a sheet to be delivered onto the intermediate process tray, wherein the controller discriminates the thickness of the sheet stack based on the sheet thickness detected by the sheet thickness sensor and a calculated number of sheets.

6. The sheet processing apparatus according to claim 1, further comprising a distance measuring sensor which measures a distance from a bottom to an upper surface of a sheet stack received on the intermediate process tray, wherein the controller discriminates the thickness of the sheet stack based on a distance value measured by the distance measuring sensor.

7. An image forming apparatus, comprising:

an image forming unit which forms an image on a sheet;

an intermediate process tray provided to a sheet processing apparatus, which receives sheets delivered from the image forming unit as a sheet stack;

a process unit which applies a predetermined process for the sheet stack received on the intermediate process tray;

a pair of rollers which nips and delivers the sheet stack subjected to the predetermined process by the process unit;

a stack tray which receives the sheet stack delivered by the pair of rollers; and a controller which moves one roller of the pair of rollers to a first standby position, after a last sheet of the sheet stack is delivered onto the intermediate process tray and before the process unit applies the predetermined process, so that the one roller of the pair of rollers does not contact the sheet stack in the first standby position, wherein the first standby position corresponds to a thickness of the sheet stack to be delivered onto the stack tray, wherein the controller causes the one roller of the pair of rollers to contact the sheet stack after the process unit applies the predetermined process, and wherein until the last sheet of the sheet stack is delivered onto the intermediate process tray the controller positions the one roller of the pair of rollers to a second standby position where an opening amount of the pair of rollers is larger than that the one of the pair of rollers is in the first standby position.

* * * * *